United States Patent [19]

Dunkley

[11] 3,955,606

[45] May 11, 1976

[54] LOADING CONTAINERS WITH POWDER

[75] Inventor: John Joseph Dunkley, Putnoe, England

[73] Assignee: Davy International Limited, London, England

[22] Filed: Nov. 7, 1974

[21] Appl. No.: 521,766

[30] Foreign Application Priority Data

Nov. 14, 1973 United Kingdom ..... 52885/73

[52] U.S. Cl. ..... 141/12; 29/424

[51] Int. Cl.[2] ..... B65B 1/04

[58] Field of Search ..... 141/12, 71–82, 141/250–284, 236, 374; 53/124 B, 24, 124 D, 124 E; 29/424

[56] References Cited

UNITED STATES PATENTS

| | | | |
|---|---|---|---|
| 2,467,683 | 4/1949 | Meyer | 141/286 |
| 3,545,503 | 12/1970 | Oshima | 141/286 |
| 3,774,658 | 3/1972 | Abramoska | 141/286 |
| 3,838,716 | 10/1974 | Ripple et al. | 141/12 |

*Primary Examiner*—Houston S. Bell, Jr.
*Attorney, Agent, or Firm*—Brisebois & Kruger

[57] ABSTRACT

When loading a cylindrical container with metal powder it is sometimes desirable to deposit the powder with the finer particles of the powder forming an outer layer surrounding the heavier coarser particles.

To bring this about the powder is allowed to fall from the outlet of a reservoir in the form of a diverging continuous curtain of circular plan in horizontal cross-section. The axis of the curtain is arranged coaxial with that of the container so that the diverging curtain is directed against the inner wall of the container.

The reservoir has a circular opening and a conical insert extends into the opening from the outside of the reservoir with the portion of the insert having the greatest diameter being positioned outside of the opening. The insert and the wall of the opening together define an annular passage which serves as the outlet of the reservoir.

5 Claims, 4 Drawing Figures

LOADING CONTAINERS WITH POWDER

Figure 1:
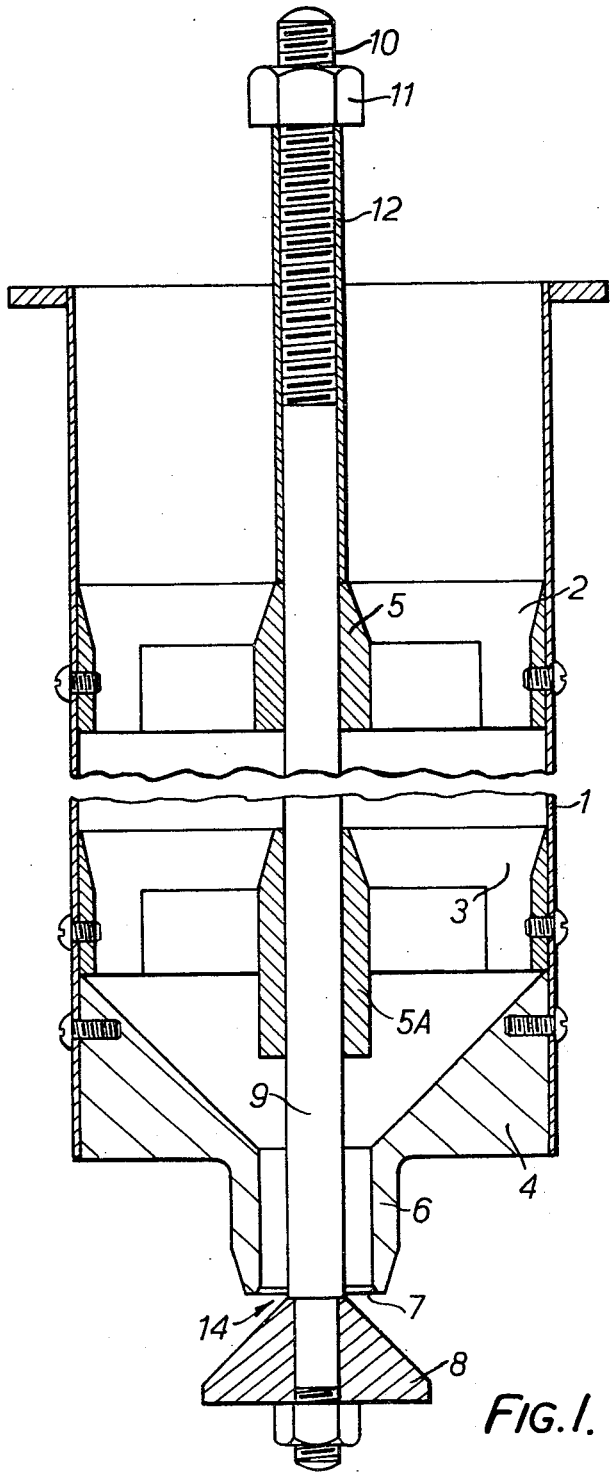

This invention relates to a method of, and apparatus for, loading a cylindrical container with metal powder.

In the manufacture of articles from metal powder it is known to introduce a quantity of the metal powder into a resilient container and to subject the container to isostatic compression forces. Although powder within a particular range of particle size is recommended for use in an isostatic compaction process, the powder which is in fact used consists of a mixture of particle sizes and it has been found that a compacted billet has an improved surface finish if the finer particles are distributed around the outer surface of the billet and that the coarser particles are contained within the layer of fine particles.

It is an object of the present invention to provide a method of and apparatus for loading a cylindrical container with metal powder in which the desirable distribution of the particles is obtained.

According to a first aspect of the present invention in a method of loading a cylindrical container with metal powder, the powder is allowed to fall from the outlet of a reservoir in the form of a diverging continuous curtain of circular plan in horizontal cross-section and the axis of the curtain and the longitudinal axis of the container are arranged coaxial so that the diverging curtain is directed against the inner wall of the container whereby the powder is deposited in the container with the finer particles of the powder forming an outer layer surrounding the heavier coarser particles.

To load a cylindrical container having a substantial axial length it is preferred for the outlet of the reservoir to be initially positioned in the container at a position above the base thereof and for the position of the outlet relative to the base of the container to be increased at a rate substantially equal to the rate of which the height of the positive powder increases in the container.

During, or after, loading of the powder into the container the container may be vibrated.

According to a second aspect of the invention apparatus for loading a cylindrical container with metal powder comprises a reservoir for the powder having a circular opening at one end and a conical insert extendable into the opening from the outside of the reservoir with the portion of the insert having the greatest diameter being positioned outside of the opening, said insert and the wall of the opening together defining an annular passage which serves as the outlet of the reservoir.

The insert may be mounted on a rod extending coaxially through said opening and by displacing the rod in the direction of its length the insert is displaced into and out of the opening to adjust the size of the annular passage.

In a preferred embodiment of the invention the reservoir is mounted at the lower end of a vertical tube with the interior of the tube being in communication with the interior of the reservoir, the tube is mounted on a platform and the platform, tube and reservoir are displaceable vertically in a support frame by means including an electric drive motor.

Figure 2:
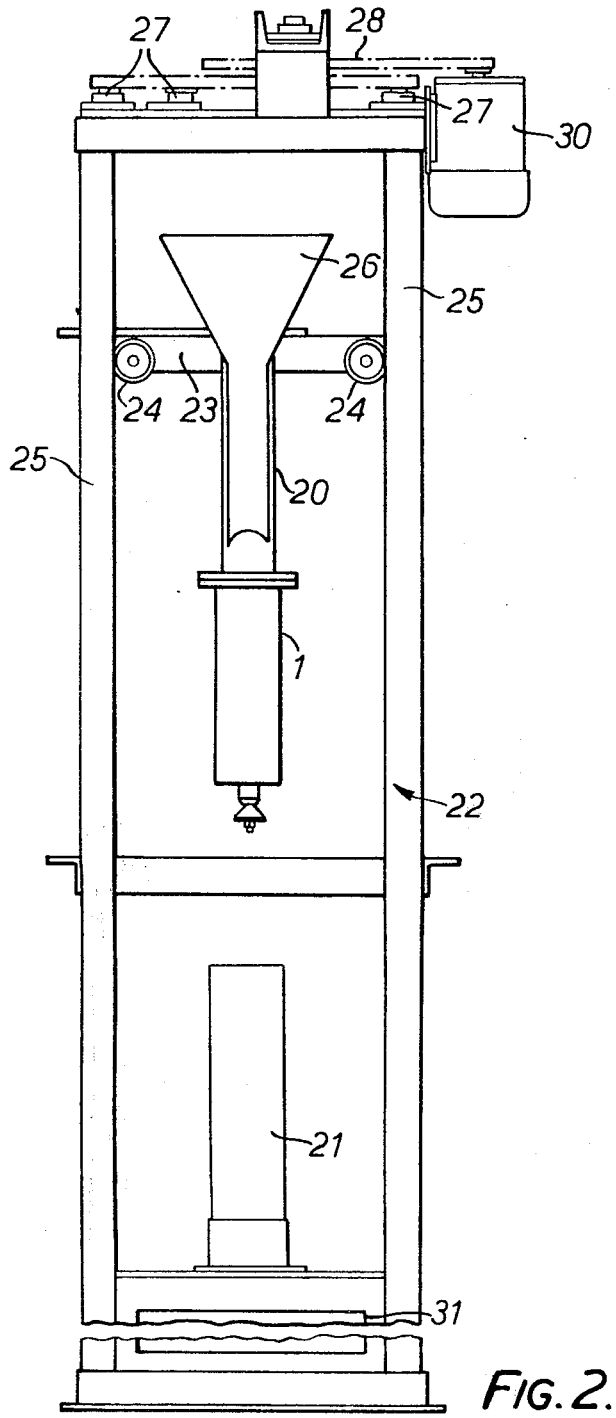

In order that the invention may be more readily understood it will now be described, by way of example only, with reference to the accompanying drawings in which FIG. 1 is a sectional side elevation of a powder reservoir in accordance with the invention, and FIG. 2 is a side elevation of a powder reservoir arranged for vertical displacement in a fixed support frame.

Figure 3:
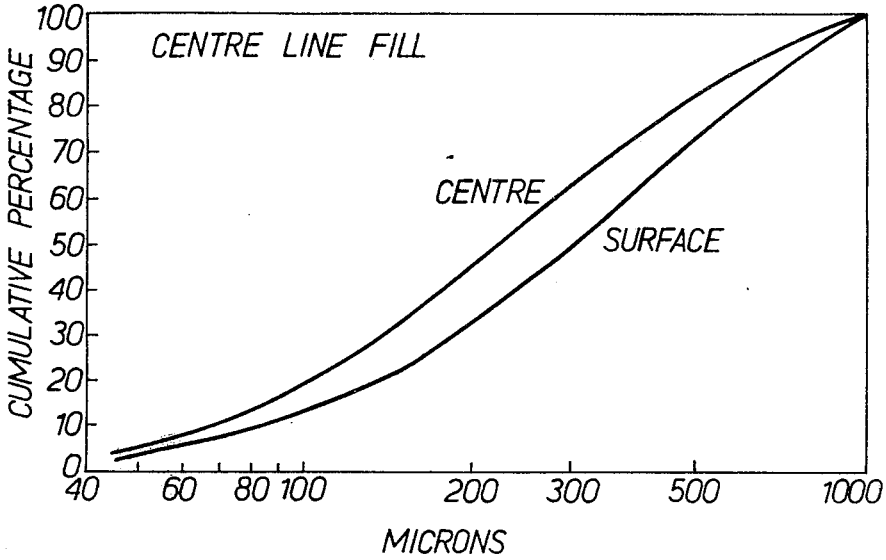
Figure 4:
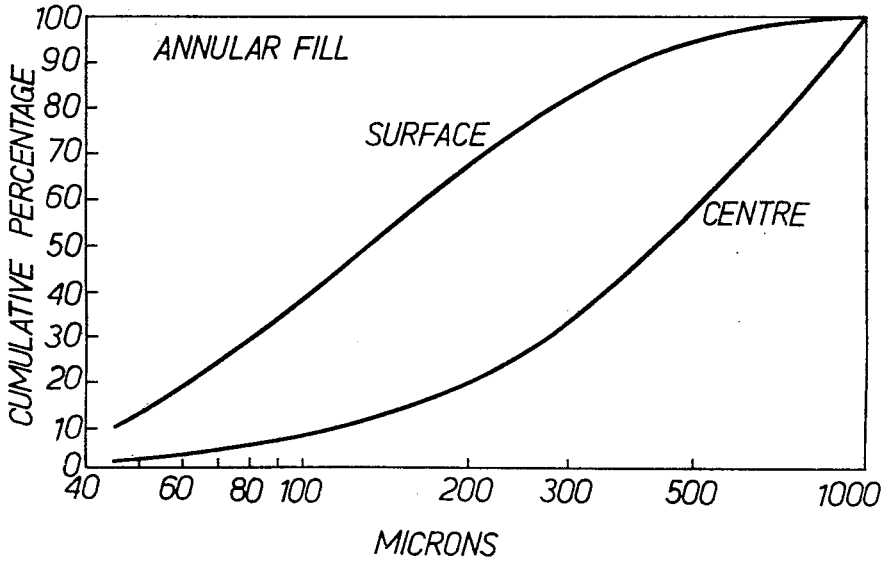

FIGS. 3 and 4 illustrate data.

Referring to FIG. 1, a powder reservoir comprises a cylindrical hollow container 1 formed from sheet metal screwed to a pair of cylindrical castings 2 and 3 and a cylindrical end nozzle 4. The castings 2 and 3 have a plurality of radial webs supporting a central bearing member 5, 5A respectively. The nozzle, located at the lower end of the reservoir has a hollow spigot 6 and the lower end of which defines an opening 7. An insert 8 of frusto-conical form is secured to one end of a rod 9 which extends through the opening 7 and is supported in the bearing members 5, 5A. The upper end portion 10 of the rod is threaded and a nut 11 on the threaded portion engages with the upper end of a spacer 12 which engages at its lower end with the cylindrical member 2. By rotating the nut 11 the rod is displaced axially of the container 1 to displace the insert 8 so that its upper end is introduceable into and out of the opening 7. The wall defining the opening and the inclined surface of the insert 8 together define an annular passage 14 which serves as the outlet of the reservoir.

When a quantity of metal powder is introduced into the reservoir it flows through the passage at the lower end in the form of a continuous diverging curtain. To fill a container with the powder the reservoir may be positioned at the upper end of the container so that the diverging curtain of powder leaving the outlet of the reservoir is directed against the inner wall of the container. The powder engaging against the wall of the container is deflected inwardly from the wall of the container but the finer particles in the powder are deflected to a considerably smaller extent than are the heavier coarser particles and it is found that the powder is deposited in the container with the finer particles of the powder forming an outer layer surrounding the heavier coarser particles.

When it is necessary to load a cylindrical container which has a considerable axial length it is desirable for the reservoir 1 to be secured to the lower end of a vertical tube 20. This tube is shown in FIG. 2. The interior of the tube 20 is in communication with the interior of the reservoir 1 and the outlet from the reservoir is arranged coaxial with the upper open end of a container 21 to be loaded with powder. The container 21 is supported in a support frame 22 and the tube 20 is mounted on a horizontal platform 23 which has wheels 24 which engage with vertical guides 25 forming part of the frame 22. A feed hopper 26 extends into the tube 20 so that powder can be introduced into the tube and then into the reservoir 1 by way of the hopper. The platform 23 carries at least three nuts (not shown) which are mounted on vertical screws, the upper ends of which are indicated by reference numeral 27. These screws are rotated together by chains 28 passing around sprockets at the upper end of the screws and the chains are driven by a drive motor 30.

To fill a container 21, the drive motor 30 is operated to lower the platform, tube 20 and reservoir 1 until the lower end of the reservoir extends into the container 21 and is positioned above the base of the container. Powder is introduced into the reservoir 1 by way of the hopper 26 and the tube 20 and as the powder falls from the reservoir in the form of a continuous divergent curtain of circular cross-section in plan it engages the inner wall of the container 21 and starts to fill up the container. The motor 30 is then driven in the direction to raise up the reservoir 1 at substantially the same rate as that at which the height of the deposited powder increases in the container 21. This is continued until the container is filled substantially to the top. During the filling of the container or alternatively after filling, the container may be vibrated by means of a vibrator 31 positioned beneath it. The vibration is used to promote densification of the powder and to level out the top surface of the powder in the container.

The resulting distribution of the particles by size in the container from the outer wall inwards is most satisfactory because if the container 21 is substantially loaded into an isostatic press and the powder compacted, the resulting billet is both free from distortion along its length and the fine powder particles produce a good surface finish on the billet. The billet may substantially be heated and extruded through the die of an extrusion press.

By way of example to illustrate the superior method of loading a container with metal powder in accordance with the invention, a container was loaded with powder in accordance with the invention and also by pouring the powder into the container along the centre line thereof. In each case a coarse powder of median particle size of 250 microns was used. Samples of powder were then taken from the centre line and the outer surface of the container and sieved. The data is shown in the accompanying table and shown in FIGS. 3 and 4 of the accompanying drawings. It can be seen at a glance that the centre line filling gives slightly coarser powder on the surface than at the centre but the annular filling in accordance with the present invention gives very much finer powder at the surface than at the centre.

CUMULATIVE SIEVE ANALYSES

| Sieve microns. | Centreline Surface | Centreline Centre | Annular Surface | Annular Centre |
|---|---|---|---|---|
| 1000 | 100 | 100 | 100 | 100 |
| 500 | 72.8 | 81.3 | 93.9 | 58.6 |
| 250 | 39.7 | 53.2 | 75.2 | 25.7 |
| 180 | 28.4 | 40.3 | 63.4 | 17.5 |
| 150 | 21.5 | 30.5 | 54.1 | 12.9 |
| 106 | 14.8 | 22.5 | 42.5 | 9.0 |
| 75 | 7.9 | 11.8 | 26.4 | 5.3 |
| 63 | 5.9 | 8.8 | 20.9 | 4.2 |
| 43 | 2.6 | 3.8 | 10.0 | 2.3 |

The invention enables powder produced by atomising a stream of molten metal to be used more efficiently in the manufacture of compacted powder billets. Atomistion produces powder within a wide range of particle sizes and heretofore it has been necessary to sieve the powder to remove at least the powder whose particle size is too large for a satisfactory surface finish to be obtained on a compacted powder billet formed from the powder. This has meant that a certain proportion of the powder produced by atomisation could not be used for powder compaction.

The present invention enables a much larger proportion of the powder produced by atomisation to be employed in the manufacture of a compacted billet because the larger particles are automatically positioned towards the centre of the container and the finer particles are positioned in a layer outside of the larger particles.

It is possible with the invention to form a satisfactory billet from a mixture of fine powder and clean metal swarf that is chips from metal cutting operations. The swarf may or may not be of exactly the same composition as the metal powder. The mixture is put into the reservoir, and then the container is loaded the finer powder particles form an outer layer surrounding the swarf.

I claim:

1. A process for loading a vertically oriented cylindrical container with metal powder comprising first particles and second particles finer than said first particles so that the second particles form an outer layer surrounding the first particles, said process comprising the steps of:

a. inserting means defining a delivery zone into the container so that said zone is coaxial with the container and spaced from the bottom thereof, b. feeding said metal powder comprising both said first and second particles out of the lower end of said delivery zone into the container in the form of a free-falling diverging continuous curtain of circular plan in horizontal cross-section, and c. maintining the delivery zone and the container so positioned relative to one another during the feeding step that the diverging curtain of powder always strikes the side wall of the container and said first particles rebound further from said side wall than said finer second particles.

2. A process as claimed in claim 1 in which during or after loading of the powder into the container, the container is vibrated.

3. A process as claimed in claim 1 in which a proportion of the first particles of the metal powder is in the form of metal swarf.

4. A process as claimed in claim 1 in which the powder in the loaded container is subjected to an isostatic compaction process to form a billet.

5. A compacted powder billet formed by the process of loading a vertically oriented cylindrical container with metal powder comprising first particles and second particles finer than said first particles so that the second particles form an outer layer surrounding the first particles, said loading process comprising the steps of:

a. inserting means defining a delivery zone into the container so that said zone is coaxial with the container and spaced from the bottom thereof, b. feeding said metal powder comprising both said first and second particles out of the lower end of said delivery zone into the container in the form of a free-falling diverging continuous curtain of circular plan in horizontal cross-section, and c. maintaining the delivery zone and the container so positioned relative to one another during the feeding step that the diverging curtain of powder always strikes the side wall of the container and said first particles rebound further from said side wall than said finer second particles; and then d. isostatically compacting the powder in the loaded container.

* * * * *